US006684405B2

(12) United States Patent
Lezdey

(10) Patent No.: US 6,684,405 B2
(45) Date of Patent: Feb. 3, 2004

(54) SURGICAL AND EXAMINATION GLOVES

(76) Inventor: John Lezdey, 148 Marcdale Blvd., Indian Rocks Beach, FL (US) 33785

( * ) Notice: Subject to any disclaimer, the term of this patent is extended or adjusted under 35 U.S.C. 154(b) by 250 days.

(21) Appl. No.: 09/873,363

(22) Filed: Jun. 5, 2001

(65) Prior Publication Data

US 2002/0189001 A1 Dec. 19, 2002

(51) Int. Cl.[7] ..... A41D 13/08

(52) U.S. Cl. ..... 2/16; 2/2.5; 2/21; 2/159; 2/161.7; 2/164; 2/167; 2/168; 424/94.1; 424/94.6; 424/94.63; 424/94.64; 128/260; 442/123; 604/292

(58) Field of Search ..... 2/2.5, 16, 21, 159, 2/161.7, 164, 167, 168, 901, 907; 424/94.1, 94.6, 94.63, 94.64; 128/260; 604/292; 442/123

(56) References Cited

U.S. PATENT DOCUMENTS 5,133,090 A * 7/1992 Modak et al. ..... 2/168
5,376,633 A * 12/1994 Lezdey et al. ..... 514/8
5,618,710 A * 4/1997 Navia et al. ..... 435/174
6,468,557 B1 * 10/2002 Lezdey et al. ..... 424/450

* cited by examiner

*Primary Examiner*—Arti R. Singh

(57) ABSTRACT

An examination or surgical glove having an inner coating of a compound which prevents the degranulation of mast cells which releases medicators of inflammation. The coating includes anti-mast cell and anti-inflammatory agents such cromolyn compounds and human type protease inhibitors.

13 Claims, No Drawings

SURGICAL AND EXAMINATION GLOVES

FIELD OF THE INVENTION

The present invention relates to surgical or examination gloves having a quick release interior. More particularly, there is provided a powdered coating for inhibiting skin irritations of users who become allergic to latex and for the prevention of accidental infections. The invention uses anti-viral protease inhibitors and cromolyn compounds alone or in combination.

BACKGROUND OF INVENTION

Surgical and examination gloves perform a barrier function providing separation between a patient and a health care worker. In fulfilling this function, the gloves act to block the introduction of infectious agents, particularly bacteria and fungi, from the hands of the healthcare worker into a surgical incision or wound of the patient. In this regard, it has been recognized that bacteria present in pores of a healthcare workers hands frequently survive antibacterial scrubbing to be released with perspiration into the interior of the glove. These bacteria pose a significant risk for infection if a tear or hole in the glove allows their release. Thus, antimicrobial gloves have been proposed with the intention of killing these released bacteria within the glove. As disclosed in U.S. Pat. No. 4,853,978 to Stockum, which is herein incorporated by reference.

The barrier function of the gloves also serves as to protect the health care worker from pathogenic agents, particularly those present in blood or other body fluids of the patient. Of particular significance in this regard are viruses, such as HIV, the virus causing Acquired Immunodeficiency Syndrome (AIDS), and Hepatitis B virus (HBV) which may even penetrate through a glove that is not actually perforated but merely stretched. Agents which are effective against these pathogenic agents, however, are less common than those that will provide an effect against simple skin bacteria or fungi and must frequently be present at much higher levels to be efficacious. This can cause difficulties for the wearer whose skin is in contact with high levels of antiinfective agent sometimes for hours at a time. It would therefore be highly advantageous to provide gloves in which an effective virucidal agent were maintained in a "ready" state, available for quick or even instant release as needed to counter the effects of possible viral contamination.

The Stockum patent cited above provides a partial but incomplete solution to this problem. Stockum discloses gloves havng an interior coating of polyurethane, starch, and chlorhexideine. Chlorhexidine has the ability to kill the AIDS virus and HBV as shown in prior commonly assigned U.S. patent application Ser. No. 07/385,290, which is incorporated herein by reference. The release rates reported by Stockum, i.e., release from the coating over several hours, are not quick enough, however, to provide meaningful protection from viral pathogens. Moreover, we have found that gloves made by dipping cured gloves in an antimicrobial preparation suffer from significant activity loss on storage, and thus from poor reliability.

Still another problem associated with rubber latex gloves pertains to the latex proteins inherently found therein. Latex proteins, which exist naturally in natural rubber latex, are essential as an emulsifier to the polyisoprene for maintaining the latex state. Unfortunately, the proteins have caused allergic reactions and other serious health problems in humans, and the latex proteins appear to have a relatively progressive effect on humans such that the undesirable reactions increase in severity with increased exposure to the proteins. For example, conventional latex gloves include a powder or donning agent such as corn starch on the surfaces thereof which facilitates removal of the gloves from a mold and facilitates placing the gloves on (donning) and removing the gloves from the users hands. Although that powder acts as a layer between the latex gloves and the hand wearing the glove, the latex proteins readily pass through the powder to the skin. In light of the health problems associated with exposure to the latex proteins, two alternative treatments for the gloves have been conventionally utilized to significantly reduce or eliminate the possibility that persons wearing the latex covered gloves will contact the latex proteins therein. Gloves treated according to such additional treatments are known as "powder-free". The first of such additional treatments is chlorination or chlorine leaching of the glove, which removes some of the proteins from the globes. Such chlorination treatment actually weakens the gloves because it initiates a deterioration process, but conventional sulfur-cure gloves remain sufficiently strong even after chlorination. The second of such additional processes involves application of a wax coating, whereby the surfaces of the conventional powdered gloves are coated with an ingestible, biodegradable wax material. The wax material may be carnauba wax, which is the same wax that is used on the candy shells of certain candy products such as M&Ms®. Although such wax coating does not degrade the desired characteristics of the latex glove, it does tend to melt to some extent after being maintained at body temperature over a period of time, and this is undesirable because the melted wax leaves a residue on the users' hands after the gloves are removed, which residue is often subsequently transferred to instruments or other articles handled by the user.

U.S. Pat. No. 5,376,633 to Lezdey et al discloses that certain protease inhibitors have anti-viral characteristics.

U.S. Pat No. 5,376,917 to Lezdey et al, which is herein incorporated by reference discloses that certain protease inhibitors are also anti-inflammatory, particularly alpha1-antitrypsin.

Co-pending application Ser. No. 09/758,593 of Lezdey et al (now abandoned) which is herein incorporated by reference discloses that cromolyn compounds prevent the degradation of mast cells which occur during allergic reactions but also anti-PAR (Protease Activation Receptor).

U.S. Pat. No. 5,618,710 to Navia et al, which is herein incorporated by reference discloses a method for stabilizes proteins by crosslinking, which can be used to stabilize the protease of the invention.

SUMMARY OF THE INVENTION

The present invention relates to surgical and examination gloves, which are commonly made from polyvinyl chloride, polyurethane, and rubber. Natural rubber latex is the preferred material. The invention provides an inner coating of at least one compound, which will prevent or inhibit an allergic reaction from use of the gloves and/or provides for anti-infection in the event of accidental seepage of body fluids, accordingly, a cromolyn compound and/or an antiviral protease inhibitor.

The cromolyn compound is one, which can prevent degranulation of mast cells, such compounds include for example, cromolyn, cromolyn sodium, and disodium cromolyn.

The protease inhibitor preferably is a serine protease inhibitor selected from the group consisting of alpha-1 antitrypsin, secretory leucocyte protease inhibitor, alpha-2 macroglobulin, the derivatives, complexes and conjugates thereof. Some cystein protease inhibitors, which are anti-viral can be used.

The cromolyn compounds and/or the protease inhibitors can be used alone or in combination with conventional lubricating agents.

It is therefore an object of the invention to provide an inner coating to surgical and examination gloves, which will prevent irritation.

It is another object of the invention to provide a latex glove, which is non-allergenic.

It is still another object of the invention to provide a latex glove with an inner coating, which is antiviral.

It is yet another object for the invention to provide a latex glove which can be easily donned.

These and other objects and advantages will become more apparent from a reading of the Description of the Preferred Embodiments and the claims.

DESCRIPTION OF THE PREFERRED EMBODIMENTS

The present invention resides in an elastomeric glove, which, is used for examination or in surgery have an inner coating of a compound, which will prevent irritation and/or can prevent infection because of seepage of body fluids. The elastomeric body may be formed from any variety of materials known in the art for the manufacture of surgical or examination gloves including polyvinylchloride, polyurethane, and silicone rubbers. Natural rubber latex is the preferred material, however, because of the flexibility and durability of this material.

The elastomeric body is formed in accordance with known procedures for the formation of gloves. Basically, these procedures involve preparing a fluid containing the elastomer, dipping a hand-shaped mandrel into the fluid to obtain a glove shaped coating, and coagulating, drying, and curing the coating. The inner coating can be incorporated on outside of the coated mandrel, after the curing step, because the glove is inverted in the process of removing it form the mandrel.

The inner coating can comprise a cromolyn compound, which can prevent the degranulation of mast cells, for example cromolyn, cromolyn sodium, and dissodium cromolyn.

The inner coating can also comprise of a protease inhibitor which is anti-viral and which binds with any of the mediators of inflammation. Preferred are the serine protease inhibitor and alpha-2 macroglobulin. The protease inhibitors are known to posses anti-inflammatory activity as well as being anti-viral agents.

Since the protease inhibitors are subject to degradation and have a short shelf life, they can be added to the gloves prior to use. Preferably, the stable form of the protease inhibitors are, used as the conjugates with polyethylene glycol, detran, cyclodextrin, and the like. The protease inhibitors can be crosslinked as disclosed in U.S. Pat. No. 5,618,710 are also useful.

For many uses, the cromolyn compounds are sufficient since they can prevent the onset of any allergic reaction of the user to the glove.

In surgical and examination procedures wherein the patient has an infectious disease, the protease inhibitors are preferred because they not only will prevent an allergic reaction but are antiviral agents for use in the event of seepage.

The cromolyn compounds can also be used in combination with the protease inhibitors. The inner coating can comprise about 3 to 10 mg. of the compounds depending upon the particular use of the glove.

The active ingredients used for the inner coating may be combined with conventional coating agents which provide improved donning properties to the gloves such as silicone, fumed silica, silicon dioxide, and the like. About 3.0 to 6.0 mg. of the conventional coating material can be utilized.

The protease inhibitors can be used in an amount of about 1.0 to 10 mg. alone or in combination with cromolyn compounds. In the case of surgery, when inorganic additives such as talc and silcon dioxide should not be utilized, the conjugates, especially the polyethylene glucol conjugates of alphal-antitrypsin provide suitable donning characteristics.

The use of plasma derived protease inhibitors, which are anti-viral and anti-inflammatory in advantageous for surgical gloves since the donning of the gloves at times causes spillage of the donning agent. Inorganic material, if released, could cause an allergic reaction in the patient.

EXAMPLE

A test was performed to compare the donnability of the gloves as compared to talc. In each run a latex examination glove was used and 6 mg. of test material was dusted into the glove. The rating was 0 to 10 with 10 being the best.

| Run | Ingredient | Amount | Rating |
|---|---|---|---|
| 1 | Talc | 6 mg. | 7 |
| 2 | Sodium Cromolyn | 6 mg. | 7 |
| 3 | Alpha 1-antitrypsin | 6 mg. | 7 |
| 4 | Cromolyn Sodium | 3 mg. | 7 |
| | Alpha 1-antitrypsin | 3 mg. | |
| 5 | Cromolyn crosslinked | 6 mg. | 8 |
| 6 | Cromolyn | 3 mg. | 10 |
| | ZnO | 3 mg. | |
| 7 | Cromolyn PEG | 6 mg. | 9 |
| 8 | Cromolyn Sodium | 3 mg | 7 |
| | Fumed Silica | 3 mg. | |
| 9 | Fumed Silica | 6 mg. | 6 |
| 10 | ZnO | 6 mg. | 10 |

Results

The compositions of the invention were as good as or better in enhancing donning capabilities without detrimental effects to their anti-inflammatory or anti-viral capabilities.

When donning the gloves each caused a slight residue on the outside of the second glove donned.

What is claimed is:

1. An examination and/or surgical glove consisting of an elastomeric hand shaped body having interior and exterior surfaces and an inner-coating disposed on the interior surface of the elastomeric body containing allergens, wherein the inner coating comprises an effective amount of a member of the group consisting of a cromolyn compound or a protease inhibitor selected from the group consisting of alpha1-antitrypsin, alpha2-macroblobulin, and secretory leucocyte protease inhibitor having anti-viral characteristics to provide an anti-allergic response to a user of said glove to allergens in the elastomeric body.

2. The glove of claim 1 wherein said cromolyn compound is selected from the group consisting of cromolyn, cromolyn sodium, and disodium cromolyn.

3. The glove of claim 1 where said protease inhibitor is crosslinked.

4. The glove of claim 1 wherein said protease inhibitor is a conjugate.

5. the glove in claim 4 wherein said conjugate is alpha1-antitrypsin with polyethylene glycol.

6. The glove of claim 1 wherein said protease inhibitor is an antiviral cysteine protease inhibitor.

7. The glove of claim 1 wherein said coating is about 1.0 to 10 mg.

8. The glove of claim 1 including a lubricant as an innercoating.

9. The glove of claim 1 wherein said inner coating contains a member selected from the group consisting of talc, fumed silica, silicon dioxide, and zinc oxide.

10. A latex surgical glove according to claim 1 comprising an interior surface having a coating of a compound selected from the group consisting of cromolyn sodium and alpha1-antitrypsin.

11. The glove of claim 10 wherein alpha1-antitrypsin is conjugated.

12. The glove of claim 10 wherein alpha1-antitrypsin is crosslinked.

13. The glove of claim 10 comprising an inner coating consisting of cromolyn sodium and alpha1-antitrypsin.

* * * * *